US008853954B2

(12) United States Patent
Otake et al.

(10) Patent No.: US 8,853,954 B2
(45) Date of Patent: Oct. 7, 2014

(54) POWER SUPPLY FOR ILLUMINATION AND LUMINAIRE

(75) Inventors: Hirokazu Otake, Kanagawa-ken (JP); Toshihiko Sasai, Kanagawa-ken (JP); Katsuyuki Kobayashi, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 151 days.

(21) Appl. No.: 13/538,502

(22) Filed: Jun. 29, 2012

(65) Prior Publication Data

US 2013/0229121 A1 Sep. 5, 2013

(30) Foreign Application Priority Data

Mar. 5, 2012 (JP) ..... 2012-048593

(51) Int. Cl.
*H05B 37/02* (2006.01)

(52) U.S. Cl.
USPC ..... 315/200 R; 315/209 R; 315/287; 315/224

(58) Field of Classification Search
CPC ..... H05B 33/0815; H05B 33/0833; H05B 33/0842; H05B 33/0845; H05B 41/3924; H05B 41/3927
USPC ..... 315/200 R, 209 R, 224, 247, 287, 291, 315/294, 297, 307, 308, 312, 360
See application file for complete search history.

(56) References Cited

U.S. PATENT DOCUMENTS

| | | | | |
|---|---|---|---|---|
| 7,821,237 | B2 | 10/2010 | Melanson | |
| 8,115,419 | B2 * | 2/2012 | Given et al. | 315/307 |
| 8,193,738 | B2 * | 6/2012 | Chu et al. | 315/307 |
| 8,487,546 | B2 * | 7/2013 | Melanson | 315/291 |
| 8,552,662 | B2 * | 10/2013 | Sun et al. | 315/294 |
| 2012/0025729 | A1 * | 2/2012 | Melanson et al. | 315/224 |
| 2012/0056553 | A1 * | 3/2012 | Koolen et al. | 315/291 |
| 2012/0086361 | A1 * | 4/2012 | Darshan | 315/307 |
| 2013/0169177 | A1 * | 7/2013 | Liao et al. | 315/200 R |
| 2013/0234616 | A1 * | 9/2013 | Kitamura et al. | 315/205 |
| 2013/0241427 | A1 * | 9/2013 | Kesterson et al. | 315/210 |

FOREIGN PATENT DOCUMENTS

| | | |
|---|---|---|
| JP | 2007-035403 | 2/2007 |
| JP | 2011-198671 A | 10/2011 |
| JP | 2011-238439 A | 11/2011 |
| TW | 201110821 A | 3/2011 |

OTHER PUBLICATIONS

Taiwan Office Action dated Jun. 3, 2014, for Application No. 101123354.

* cited by examiner

*Primary Examiner* — Vibol Tan
(74) *Attorney, Agent, or Firm* — Patterson & Sheridan LLP

(57) ABSTRACT

A power supply for illumination includes a detection circuit and a control circuit. The detection circuit compares an AC voltage whose phase is controlled with a first threshold voltage so as to detect a variation in a conduction state of phase control in the AC voltage, and compares the AC voltage with a second threshold voltage lower than the first threshold voltage so as to detect a zero-cross point of the AC voltage, thereby detecting a conduction period of the phase control. The control circuit outputs an output current according to the duration of the conduction period.

18 Claims, 10 Drawing Sheets

VIN
0
time

VRE
0
V1
V2

CTL
0

VDS
0
TON
TOFF

POWER SUPPLY FOR ILLUMINATION AND LUMINAIRE

CROSS-REFERENCE TO RELATED APPLICATIONS

This application is based upon and claims the benefit of priority from the prior Japanese Patent Application No. 2012-048593, filed on Mar. 5, 2012; the entire contents of which are incorporated herein by reference.

FIELD

Exemplary embodiments described herein relate to a power supply for illumination, a luminaire and a method of generating power.

BACKGROUND

In recent years, in illumination devices, illumination light sources are progressing to replace light bulbs or fluorescent lamps with power saving and long life light sources, for example, light emitting diodes (LEDs). In addition, new illumination light sources such as, for example, Electro-Luminescence (EL) or an organic light emitting diode (OLED) are under development. Since a light output of such an illumination light source depends on the value of a flowing current, a power supply circuit supplying a constant current is necessary to light illumination. In addition, a supplied current is controlled for dimming.

For example, a dimmer of a two-wire type or like which is configured to control a phase where a triac is turned on is widespread as a dimmer of the light bulb. For this reason, an illumination light source such as an LED can be preferably dimmed with the dimmer.

However, there are cases where an output voltage of the dimmer varies due to a variation in a power supply voltage and thus flickering occurs.

DETAILED DESCRIPTION

Figure 1:
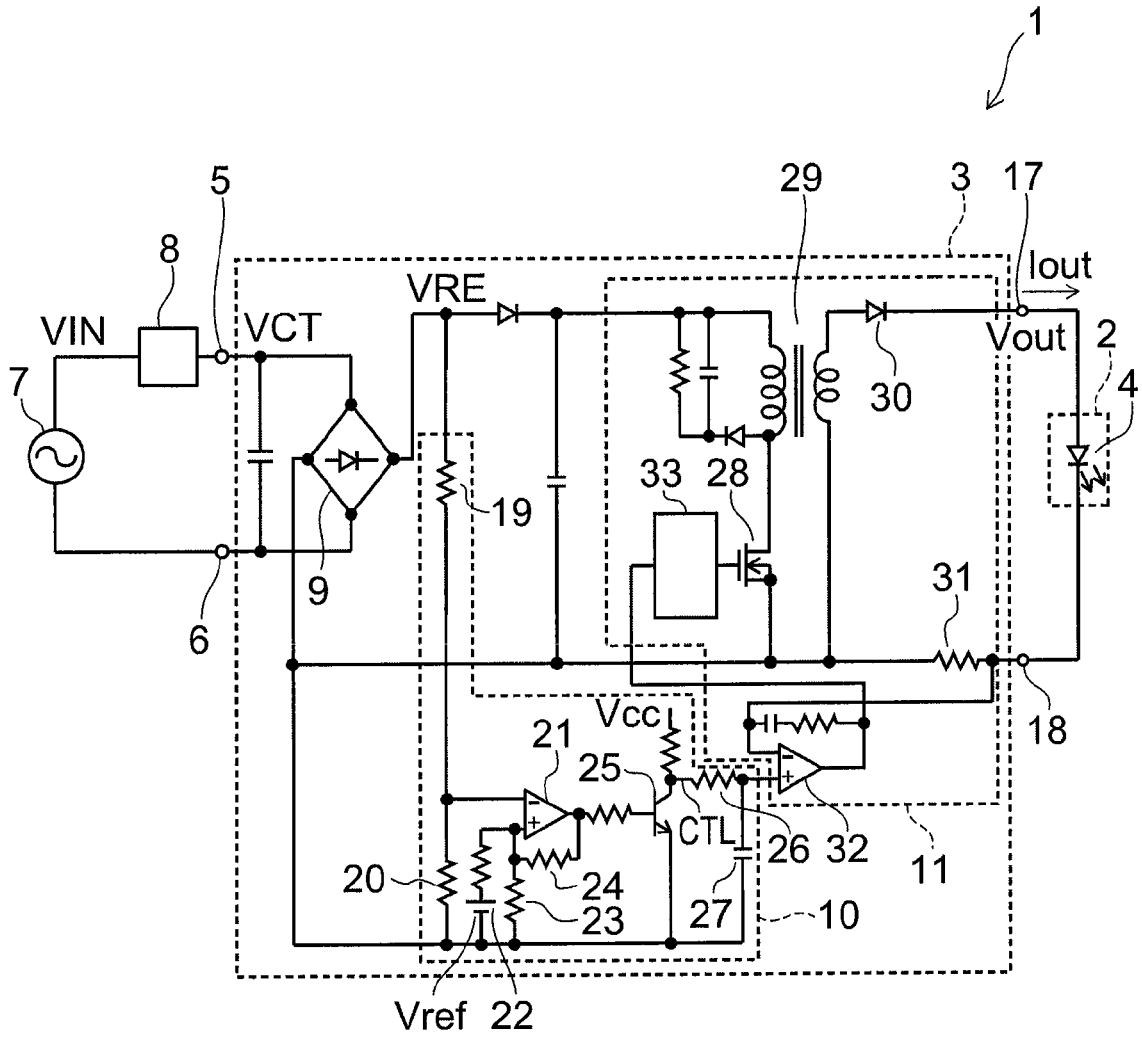
FIG. 1 is a block diagram exemplifying a luminaire including a power supply for illumination according to a first embodiment.

A power supply for illumination of an exemplary embodiment includes a detection circuit and a control circuit. The detection circuit compares an AC voltage whose phase is controlled with a first threshold voltage so as to detect a variation in a conduction state of phase control in the AC voltage, and compares the AC voltage with a second threshold voltage lower than the first threshold voltage so as to detect a zero-cross point of the AC voltage, thereby detecting a conduction period of the phase control. The control circuit outputs an output current according to the duration of the conduction period.

In addition, a luminaire of another exemplary embodiment includes a power supply for illumination and an illumination load. The power supply for illumination includes a first lighting circuit and a back-flow prevention circuit. The first lighting circuit converts and outputs power supplied from a first power supply. The back-flow prevention circuit is connected to the first lighting circuit and blocks a current from flowing back to an output side of the first light circuit. The illumination load is connected to the power supply for illumination as a load.

Hereinafter, embodiments will be described in detail with reference to the drawings. In addition, in the present specification and the drawings, the same constituent elements as described in the preceding drawings are given the same reference numerals, and detailed description thereof will be appropriately omitted.

First Embodiment

FIG. 1 is a circuit diagram exemplifying a luminaire including a power supply for illumination according to the first embodiment.

The luminaire 1 according to the first embodiment includes an illumination load 2 and a power supply 3 for illumination supplying power to the illumination load 2.

The illumination load 2 includes an illumination light source 4 such as, for example, an LED, and is lighted by being supplied with an output voltage VOUT and an output current IOUT from the power supply 3 for illumination. In addition, the illumination load 2 can dim by varying at least one of the output voltage VOUT and the output current IOUT.

The power supply 3 for illumination is connected to an AC power supply 7 via a dimmer 8. The power supply 3 for illumination converts an AC voltage VCT whose phase is controlled and which is input to a pair of input terminals 5 and 6, and outputs the output voltage VOUT to a pair of output terminals 17 and 18. In addition, the AC power supply 7 is, for example, a commercial power supply. In the present embodiment, although a configuration where the dimmer 8 is inserted in series into one of a pair of power supply lines which supplies a power supply voltage VIN is exemplified, other configurations may be employed.

Figure 2:
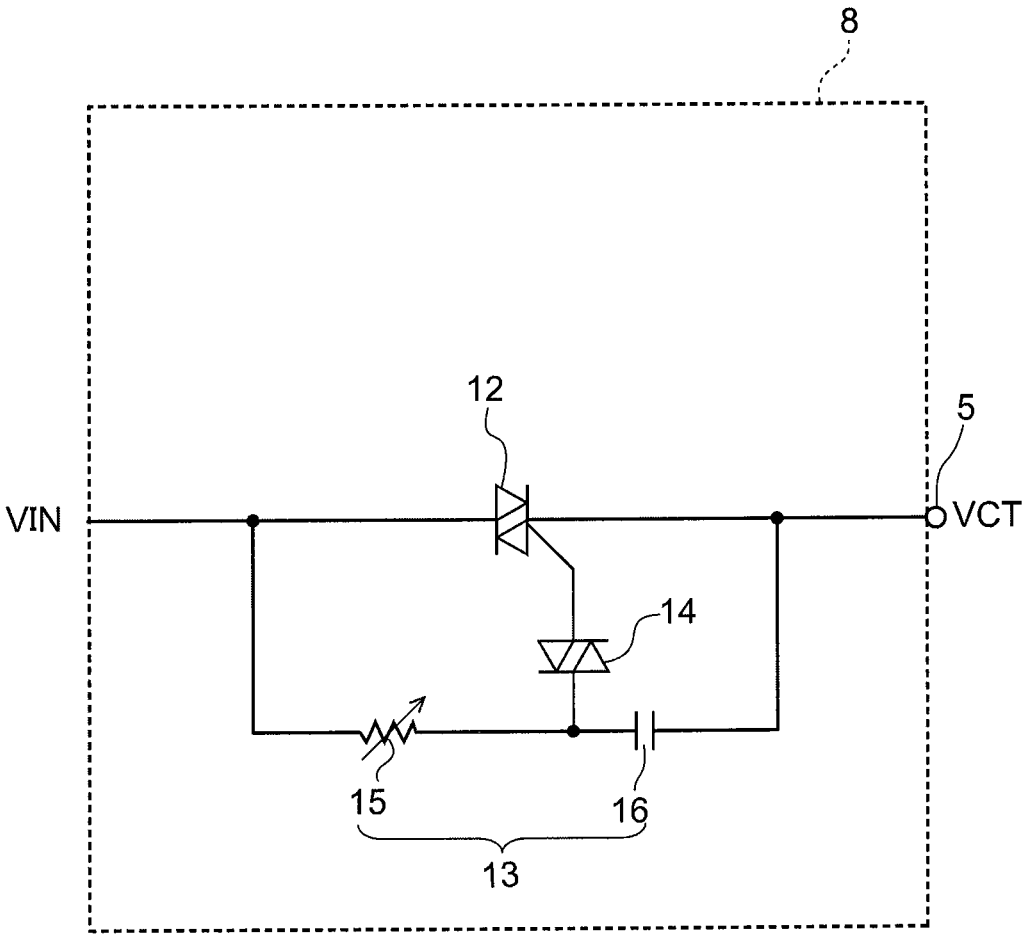
FIG. 2 is a circuit diagram exemplifying a dimmer.

FIG. 2 is a circuit diagram exemplifying the dimmer.

The dimmer 8 includes a triac 12 inserted in series into the power supply line, a phase circuit 13 connected in parallel to the triac 12, and a diac 14 connected between a gate of the triac 12 and the phase circuit 13.

The triac 12 is normally in a turned-off state, and is turned on if a pulse signal is input to the gate thereof. The triac 12 can make a current flow in both directions when the AC power supply voltage VIN is positive and negative.

The phase circuit 13 is constituted by a variable resistor 15 and a timing capacitor 16, and generates a voltage whose phase is delayed at both ends of the timing capacitor 16. In addition, if a resistance value of the variable resistor 15 is varied, the time constant is varied, and thus a delay time is varied.

The diac 14 generates a pulse voltage if a voltage charged in the capacitor of the phase circuit 13 exceeds a specific value, and turns on the triac 12.

It is possible to adjust a timing when the triac 12 is turned on by controlling a timing when the diac 14 generates pulses by varying the time constant of the phase circuit 13. Therefore, the dimmer 8 can adjust a conduction period of phase control in the AC voltage VCT.

Referring to FIG. 1 again, the power supply 3 for illumination includes a rectifying circuit 9, a detection circuit 10, and a control circuit 11.

The rectifying circuit 9 is constituted by a diode bridge. The rectifying circuit 9 receives the AC voltage VCT whose phase is controlled via the dimmer 8 and outputs an undulating voltage VRE whose phase is controlled. In addition, the rectifying circuit 9 may rectify the AC voltage VCT input from the dimmer 8, or may have other configurations. In addition, a capacitor for reducing high frequency noise is connected to an input side of the rectifying circuit 9.

The detection circuit 10 includes dividing resistors 19 and 20, a comparison circuit 21, a reference voltage source 22, resistors 23, 24 and 26, an inverter (inversion circuit) 25, and a capacitor 27.

The dividing resistors 19 and 20 are connected to an output side of the rectifying circuit 9 and divide the undulating voltage VRE.

A voltage which is obtained by the dividing resistors 19 and 20 dividing the undulating voltage VRE is input to an inverting input terminal (−) of the comparison circuit 21. A reference voltage Vref from the reference voltage source 22 and a voltage obtained by the resistors 23 and 24 dividing an output voltage of the comparison circuit 21 are input to a non-inverting input terminal (+) of the comparison circuit 21.

The comparison circuit 21 constitutes a hysteresis comparator. A first threshold voltage is V1 if an output thereof is in a high level, and a second threshold voltage is V2, which is lower than the first threshold voltage V1, if the output thereof is in a low level. Here, the first threshold voltage V1, as described with reference to FIG. 3, is set to a voltage higher than a voltage during a blocking period TOFF of phase control of the AC voltage VCT whose phase is controlled by the dimmer 8 or the undulating voltage VRE obtained by rectifying the AC voltage VCT. In addition, the first threshold voltage V1 is set to be lower than an instantaneous value V3 of the AC voltage VCT at the time of starting conduction of phase control when a phase is controlled such that a maximum output is supplied from the AC voltage VCT. The second threshold voltage V2 is set to a voltage lower than the first threshold voltage V1 and a voltage during the blocking period TOFF of phase control of the AC voltage VCT or the undulating voltage VRE. Further, in the comparison circuit 21, a voltage value obtained by the resistors 23 and 24 dividing the second threshold voltage V2 is almost the same as the reference voltage Vref.

The inverter 25 is constituted by an NPN transistor, and inverts an output of the comparison circuit 21 so as to output a control signal CTL. The inverter 25 is supplied with a stabilized voltage VCC via a resistor. Therefore, a high level of the control signal CTL becomes the stabilized voltage VCC, and thus influence of variations in the power supply voltage is reduced. The control signal CTL is smoothened via an integration circuit constituted by a resistor 26 and a capacitor 27 and is output as an average voltage.

The control circuit 11 includes a switching element 28, a transformer 29, a rectifying element 30, a current detection resistor 31, an amplifying circuit 32, and a driving circuit 33.

A voltage rectified by the rectifying circuit 9 is supplied to a primary side of the transformer 29 via the switching element 28. In addition, a secondary side of the transformer 29 is connected to the output terminals 17 and 18 via the rectifying element 30 and the current detection resistor 31. When the switching element 28 is turned on, a current flows through the transformer 29 by a voltage obtained by smoothing the undulating voltage VRE and thus energy is accumulated, and when the switching element 28 is turned off, the output current IOUT flows through the secondary side of the transformer 29 via the rectifying element 30 by the accumulated energy. In addition, the switching element 28 is, for example, an FET.

The amplifying circuit 32 amplifies a voltage difference between an average value of the control signal CTL output from the detection circuit 10 via the integration circuit constituted by the resistor 26 and the capacitor 27, and a voltage of the current detection resistor 31. The amplifying circuit 32 outputs a positive voltage if the average value of the control signal CTL is larger than the voltage of the current detection resistor 31, and outputs a negative voltage if the average value of the control signal CTL is smaller than the voltage of the current detection resistor 31.

The amplifying circuit 32 drives the switching element 28 via the driving circuit 33. For example, when the amplifying circuit 32 outputs a positive voltage, the switching element 28 is driven in a turned-on state, and when the amplifying circuit 32 outputs a negative voltage, the switching element 28 is driven in a turned-off state. The control circuit 11 controls the output current IOUT so as to have an average value according to a high level period of the control signal CTL.

Figure 3A:
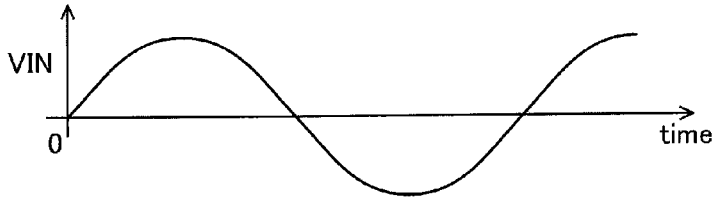
FIGS. 3A to 3D are timing charts of the main signals of the power supply for illumination according to the first embodiment.
Figure 3B:
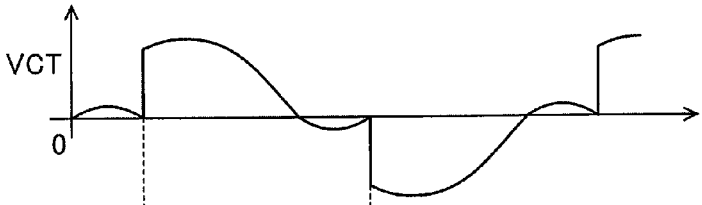
Figure 3C:
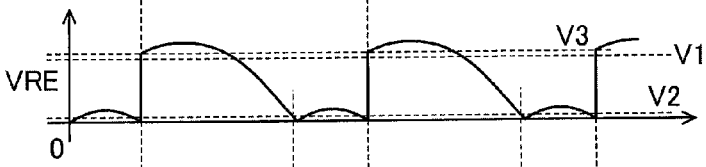
Figure 3D:
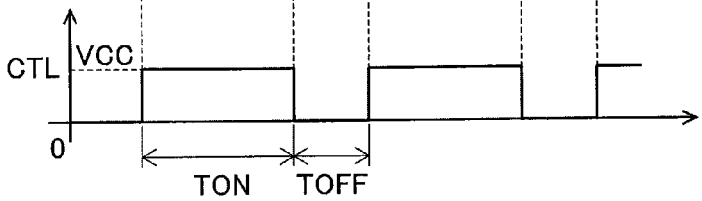

FIGS. 3A to 3D are timing charts of the main signals of the power supply for illumination according to the first embodiment, wherein FIG. 3A shows the power supply voltage VIN, FIG. 3B shows the AC voltage VCT whose phase is controlled, FIG. 3C shows the undulating voltage VRE, and FIG. 3D shows the control signal CTL.

The input power supply voltage VIN is, for example, an AC voltage of a commercial power supply, and is a sinusoidal voltage (FIG. 3A).

The AC voltage VCT whose phase is controlled by the dimmer 8 is almost the same as the power supply voltage VIN input during the conduction period TON of the phase control, and is a minute voltage during the blocking period TOFF of the phase control (FIG. 3B).

As described above, the dimmer 8 has a function of conducting or blocking a current at least once per half cycle. The dimmer includes a two-wire type dimmer inserted into one of a pair of power supply lines as exemplified in FIG. 2, and a three-wire type dimmer where a semiconductor switch is inserted into one of the power supply lines and a circuit controlling the semiconductor switch is inserted in parallel into the power supply lines. In the two-wire type and three-wire type dimmers, since a current for biasing the semiconductor switch flows into an output thereof during a turned-off period of the semiconductor switch, an output voltage of the dimmers does not become zero.

For example, in the two-wire type dimmer 8 as shown in FIG. 2, a current for charging the timing capacitor 16 leaks to the output of the dimmer until the diac 14 for triggering the triac 12 reaches a breakover voltage, but the charging current of the timing capacitor 16 is shown as an output voltage of the dimmer 8 at a phase where input impedance of the load is high (FIG. 3B). In addition, the three-wire type dimmer and post-cut phase control (also referred to as a reverse phase control;

an operation and a control phase in the dimmer 8 are reversed) will be described with reference to FIG. 5.

The undulating voltage VRE rectified by the rectifying circuit 9 is a voltage obtained by repeating the AC voltage VCT on the positive side (FIG. 3C). In addition, FIG. 3C shows the first threshold voltage V1, the second threshold voltage V2, and the instantaneous value V3 of the AC voltage VCT whose phase is controlled such that the maximum output is supplied from the AC voltage VCT.

When the undulating voltage VRE increases from zero, the comparison circuit 21 outputs a high level, and compares the undulating voltage VRE with the first threshold voltage V1 which is relatively high. When the undulating voltage VRE increases over the first threshold voltage V1, the comparison circuit 21 outputs a low level. As a result, the inverter 25 outputs a high level as the control signal CTL (FIG. 3D).

Since the comparison circuit 21 outputs a low level, a threshold voltage of the comparison circuit 21 becomes the second threshold voltage V2 which is relatively low.

If the undulating voltage VRE decreases below the second threshold voltage V2, the comparison circuit 21 detects a zero-cross point and outputs a high level. As a result, the inverter 25 outputs a low level as the control signal CTL (FIG. 3D). A period of the high level of the control signal CTL is the conduction period TON of the phase control (FIG. 3D).

Since the comparison circuit 21 outputs a high level, a threshold voltage of the comparison circuit 21 becomes the first threshold voltage V1 which is relatively high.

If the undulating voltage VRE increases over the first threshold voltage V1, the comparison circuit 21 outputs a low level, and the inverter 25 outputs a high level as the control signal CTL (FIG. 3D). A period of the low level of the control signal CTL becomes the blocking period TOFF of the phase control (FIG. 3D).

The control signal CTL is smoothened via the integration circuit constituted by the resistor 26 and the capacitor 27 and is input to the control circuit 11. In addition, as described above, the control circuit 11 outputs the output current IOUT according to the period of the high level of the control signal CTL, that is, the duration of the conduction period TON of the phase control.

In the present embodiment, the conduction period TON of the phase control is detected, and the output current IOUT according to the duration of the conduction period TON is output. As a result, it is possible to suppress a variation in the output current IOUT due to a variation in the power supply voltage or distortion of the power supply voltage. In addition, in the luminaire using the power supply for illumination according to the present embodiment, it is possible to smoothly dim by suppressing flickering due to a variation in the power supply voltage or distortion of the power supply voltage.

In the present embodiment, as the first threshold voltage V1 for detecting the start time of the conduction period TON of the phase control, a voltage higher than a voltage increased due to a current which leaks out of the dimmer 8 during the blocking period TOFF of the phase control is set. As a result, it is possible to accurately detect starting of the conduction period TON.

Further, in the present embodiment, as the second threshold voltage V2 for detecting the end time of the conduction period TON of the phase control using the zero-cross point of the undulating voltage VRE, a voltage which is lower than the first threshold voltage V1 and is lower than a voltage increased by a current leaking out of the dimmer 8 is set. As a result, it is possible to accurately detect the conduction period TON by reducing influence of a variation in the power supply voltage or the like, and to thereby accurately control the output current IOUT. In addition, in the luminaire using the power supply for illumination according to the present embodiment, it is possible to smoothly dim by further reducing influence of a variation in the power supply voltage or the like and suppressing flickering.

Second Embodiment

Figure 4:
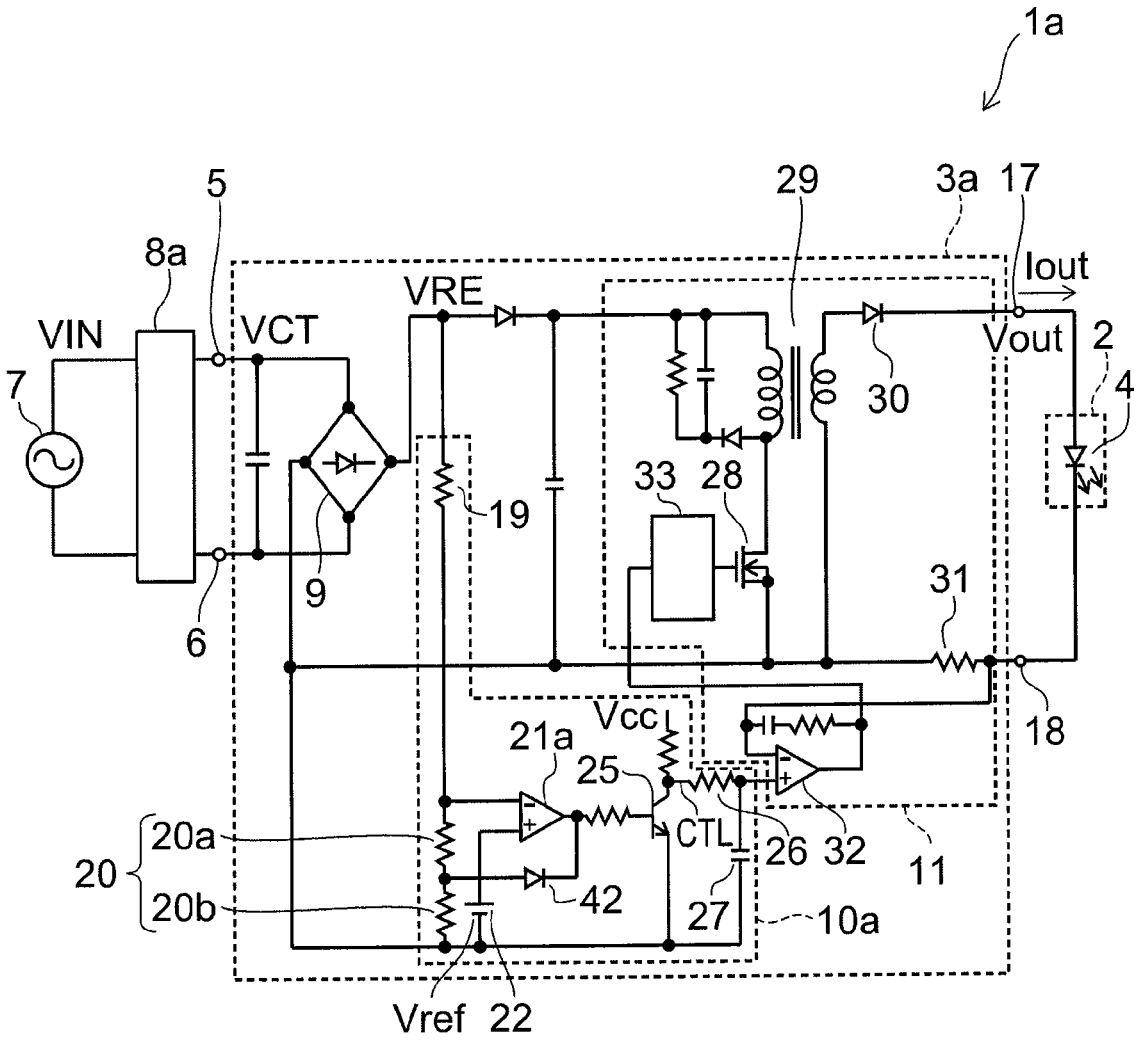
FIG. 4 is a circuit diagram exemplifying a luminaire including a power supply for illumination according to a second embodiment.

FIG. 4 is a circuit diagram exemplifying a luminaire including a power supply for illumination according to the second embodiment.

The luminaire 1*a* according to the second embodiment differs in a configuration of the power supply 3 for illumination as compared with the luminaire 1 according to the first embodiment. In other words, a power supply 3*a* for illumination of the luminaire 1*a* is configured to replace the detection circuit 10 of the power supply 3 for illumination with a detection circuit 10*a*. In addition, input terminals 5 and 6 of the luminaire 1*a* are connected to the AC power supply via a dimmer 8*a*. Configurations other than the above-described configurations of the luminaire 1*a* are the same as the configurations of the luminaire 1.

Figure 5:
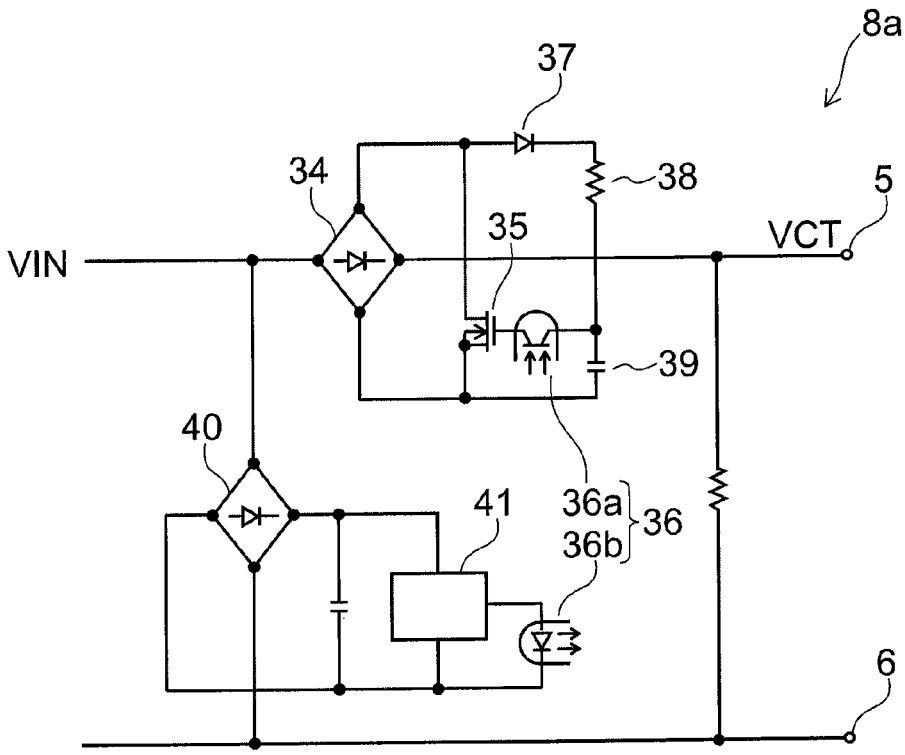
FIG. 5 is a circuit diagram exemplifying a dimmer.

FIG. 5 is another circuit diagram exemplifying the dimmer.

The dimmer 8*a* includes rectifying circuits 34 and 40, a semiconductor switch 35, a photo-coupler 36, a diode 37, a resistor 38, a capacitor 39, and a dimming control circuit 41.

The rectifying circuit 34 is inserted in series into one of a pair of power supply lines. The semiconductor switch 35 is, for example, an FET, and is connected between a pair of output terminals of the rectifying circuit 34. In addition, the diode 37, the resistor 38, and the capacitor 39 are connected in series between a pair of output terminals of the rectifying circuit 34, and constitute a bias circuit for turning on the semiconductor switch 35.

The photo-coupler 36 includes a light receiving element 36*a* and a light emitting element 36*b*, and the light receiving element 36*a* is connected between a control terminal (gate) of the semiconductor switch 35 and the capacitor 39 constituting the bias circuit. If the light receiving element 36*a* of the photo-coupler 36 is turned on, a voltage of the capacitor 39 is applied to the control terminal of the semiconductor switch 35.

The rectifying circuit 40 is connected in parallel to a pair of power supply lines. The dimming control circuit 41 is connected between a pair of output terminals of the rectifying circuit 40. In addition, an output of the dimming control circuit 41 is connected to the light emitting element 36*b* of the photo-coupler 36. If the light emitting element 36*b* emits light, the light receiving element 36*a* is turned on, and thus a voltage of the capacitor 39 is applied to the control terminal of the semiconductor switch 35. As a result, the semiconductor switch 35 is turned on, and in turn the dimmer 8*a* enters a turned-on state. In addition, when the light emitting element 36*b* does not emit light, the light receiving element 36*a* is turned off, the semiconductor switch 35 is turned off, and thus the dimmer 8*a* enters a turned-off state.

The dimming control circuit 41 is constituted by, for example, a microcomputer, adjusts a timing for emission of the light emitting element 36*b*, and dims by controlling the conduction period TON of the phase control in the input power supply voltage VIN.

Referring to FIG. 4 again, the detection circuit 10*a* of the power supply 3*a* for illumination differs in a configuration of peripheral circuits of the comparison circuit 21 such as the dividing resistor 20, the comparison circuit 21, and the resistors 23 and 24 as compared with the detection circuit 10 of the power supply 3 for illumination. In other words, in the detection circuit 10*a*, the dividing resistor 20 is replaced with dividing resistors 20*a* and 20*b* connected in series to each other, and the resistors 23 and 24 are replaced with a diode 42 connected between a connection point of the dividing resistors 20*a* and 20*b* and an output of a comparison circuit 21*a*. In addition, a configuration itself of the comparison circuit 21*a* is the same as that of the comparison circuit 21.

If a voltage obtained by dividing the undulating voltage VRE input to an inverting terminal of the comparison circuit 21*a* is relatively low, the comparison circuit 21*a* outputs a high level. As a result, the diode 42 is reverse-biased and is thus turned off, and a relatively high voltage according to dividing resistors 19, 20*a* and 20*b* connected in series is input to the comparison circuit 21*a*.

In addition, if a voltage obtained by dividing the undulating voltage VRE input to an inverting terminal of the comparison circuit 21*a* is relatively high, the comparison circuit 21*a* outputs a low level. As a result, the diode 42 is forward-biased and is thus turned on, and a relatively low voltage according to the dividing resistors 19 and 20*a* connected in series is input to the comparison circuit 21*a*.

Therefore, a threshold voltage for reversing an output when the undulating voltage VRE is relatively low and the output of the comparison circuit 21*a* is in a high level, to a low level, corresponds to the second threshold voltage V2 which is relatively low. In addition, a threshold voltage for reversing an output when the undulating voltage VRE is relatively high and the output of the comparison circuit 21*a* is in a low level, to a high level, corresponds to the first threshold voltage V1 which is relatively high. The comparison circuit 21*a* constitutes a hysteresis comparator.

In addition, in the present embodiment as well, the first threshold voltage V1 is set to a voltage which is higher than a voltage during the blocking period TOFF of the phase control of the AC voltage VCT whose phase is controlled by the dimmer 8*a* or the undulating voltage VRE obtained by rectifying the AC voltage VCT. Further, the first threshold voltage V1 is set to be lower than the instantaneous value V3 of the start time of conduction of an AC voltage whose phase is controlled such that a maximum output is supplied from the AC voltage VCT. The second threshold voltage V2 is set to a voltage lower than the first threshold voltage V1 and a voltage during the blocking period TOFF of phase control of the AC voltage VCT or the undulating voltage VRE.

Figures 6A, 6B, 6C, 6D:
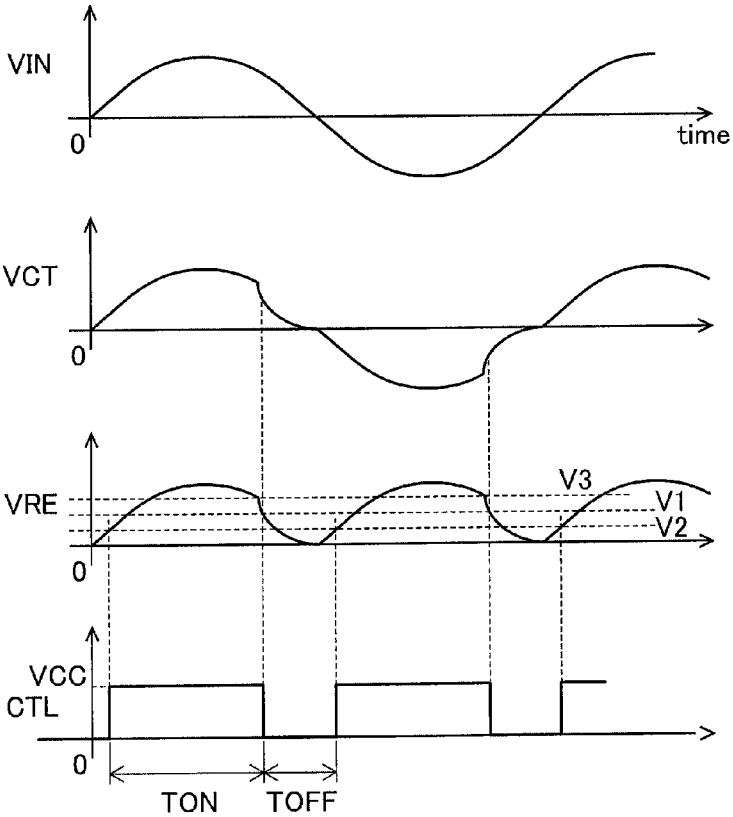
FIGS. 6A to 6D are timing charts of the main signals of the power supply for illumination according to the second embodiment.

FIGS. 6A to 6D are timing charts of the main signals of the power supply for illumination according to the second embodiment, wherein FIG. 6A shows the power supply voltage VIN, FIG. 6B shows the AC voltage VCT whose phase is controlled, FIG. 6C shows the undulating voltage VRE, and FIG. 6D shows the control signal CTL.

The input power supply voltage VIN is, for example, an AC voltage of a commercial power supply, and is a sinusoidal voltage (FIG. 6A). The dimmer 8*a* is a three-wire type dimmer in which the circuit controlling the semiconductor switch 35 is inserted in parallel into the power supply lines, and the post-cut phase control (reverse phase control) where an operation and a control phase in the dimmer 8 are reversed is exemplified (FIG. 6B).

The AC voltage VCT whose phase is controlled by the dimmer 8*a* is almost the same as the input power supply voltage VIN during the conduction period TON of the phase control, and is a slowly decreasing voltage during the blocking period TOFF of the phase control (FIG. 6B).

For example, generally, a capacitor is inserted between the input terminals 5 and 6 of the power supply 3*a* for illumination, aiming at noise removal or the like. The dimmer 8*a* of the reverse phase control operates so as to block power supply at a predetermined timing. However, if there is floating capacitance in the capacitor inserted between the input terminals 5 and 6 or wires aiming at noise removal or the like, it takes time to discharge remaining electric charge even if the dimmer 8*a* performs the blocking operation, and thus the AC voltage VCT input to the power supply 3*a* for illumination does not decrease instantaneously (FIG. 6B).

The undulating voltage VRE rectified by the rectifying circuit 9 is a voltage obtained by repeating the AC voltage VCT on the positive side (FIG. 6C). In addition, FIG. 6C shows the first threshold voltage V1, the second threshold voltage V2, and the instantaneous value V3 of the AC voltage VCT.

As described above, when the undulating voltage VRE increases from zero, the comparison circuit 21*a* outputs a high level, and compares the undulating voltage VRE with the second threshold voltage V2 which is relatively low. When the undulating voltage VRE increases over the second threshold voltage V2, the comparison circuit 21*a* detects a zero-cross point, and outputs a low level. As a result, the inverter 25 outputs a high level as the control signal CTL (FIG. 6D).

Since the comparison circuit 21*a* outputs a low level, a threshold voltage of the comparison circuit 21*a* becomes the first threshold voltage V1 which is relatively high.

If the undulating voltage VRE increases to a peak value and then decreases below the first threshold voltage V1, the comparison circuit 21*a* outputs a high level. As a result, the inverter 25 outputs a low level as the control signal CTL (FIG. 6D). A period of the high level of the control signal CTL is the conduction period TON of the phase control (FIG. 6D).

Since the comparison circuit 21*a* outputs a high level, a threshold voltage of the comparison circuit 21*a* becomes the second threshold voltage V2 which is relatively low.

If the undulating voltage VRE increases over the second threshold voltage V2, the comparison circuit 21*a* outputs a low level, and the inverter 25 outputs a high level as the control signal CTL (FIG. 6D). A period of the low level of the control signal CTL becomes the blocking period TOFF of the phase control (FIG. 6D).

The control signal CTL is smoothened via the integration circuit constituted by the resistor 26 and the capacitor 27 and is input to the control circuit 11. In addition, as described above, the control circuit 11 outputs the output current IOUT according to the period of the high level of the control signal CTL, that is, the duration of the conduction period TON of the phase control.

In the present embodiment, a relatively low voltage is set as the second threshold voltage V2 when the start time of the conduction period TON of the phase control is detected using the zero-cross point. As a result, it is possible to accurately detect starting of the conduction period TON.

In addition, in the present embodiment, the first threshold voltage V1 for detecting the end time of the conduction period TON of the phase control is set to be higher than the second threshold voltage V2. As a result, by reducing the influence that the voltage slowly decreases in switching from conduction to blocking of the phase control due to input capacitance of the power supply 3*a* for illumination, it is possible to accurately detect the conduction period TON and to thereby accurately control the output current IOUT. In addition, in the luminaire using the power supply for illumination according to the present embodiment, it is possible to smoothly dim by further reducing influence of a variation in the power supply voltage or the like and suppressing flickering.

Effects other than the above-described effect of the present embodiment are the same as the effects of the first embodiment.

Third Embodiment

Figure 7:
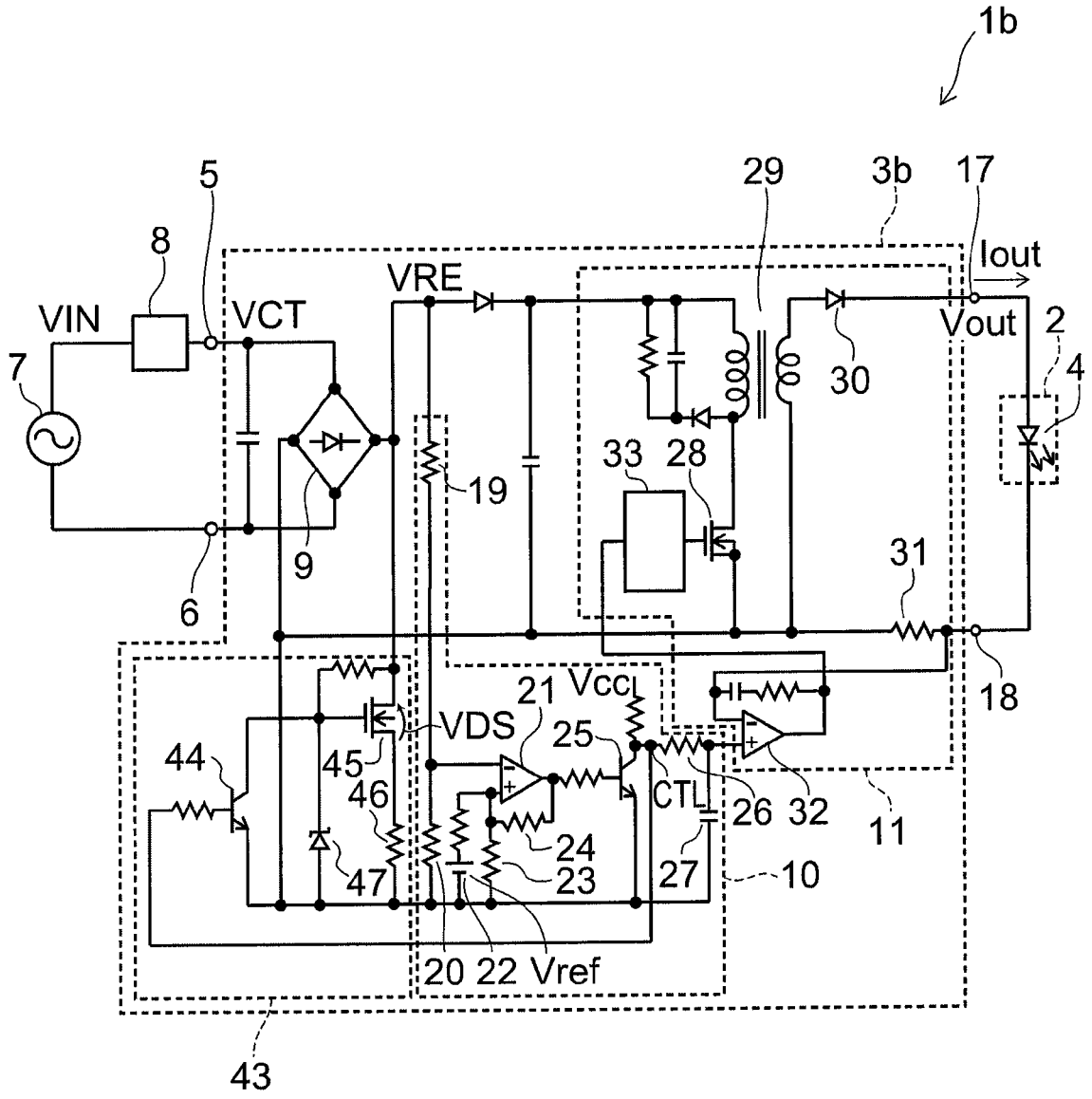
FIG. 7 is a circuit diagram exemplifying a luminaire including a power supply for illumination according to a third embodiment.

FIG. 7 is a circuit diagram exemplifying a luminaire including a power supply for illumination according to the third embodiment.

The luminaire 1*b* according to the third embodiment differs in a configuration of the power supply 3 for illumination as compared with the luminaire 1 according to the first embodiment. In other words, the luminaire 1*b* is configured to replace the power supply 3 for illumination of the luminaire 1 with a power supply 3*b* for illumination. Configurations other than the above-described configuration of the luminaire 1*b* are the same as the configurations of the luminaire 1.

The power supply 3*b* for illumination is different from the power supply 3 for illumination in that a bleeder circuit 43 which makes an input current smaller than the output current IOUT flow via the rectifying circuit 9 during the blocking period TOFF of the phase control is further provided.

The bleeder circuit 43 includes an inverter 44, a switching element 45, a resistor 46, and a zener diode 47. The inverter 44 is constituted by an NPN transistor, and generates a signal obtained by inverting the control signal CTL. The switching element 45 is, for example, an FET, and is connected between a pair of output terminals of the rectifying circuit 9 via the resistor 46. A control terminal (gate) of the switching element 45 is connected to an output of the inverter 44. In addition, the control terminal of the switching element 45 is connected to the zener diode 47.

Figures 8A, 8B, 8C, 8D:
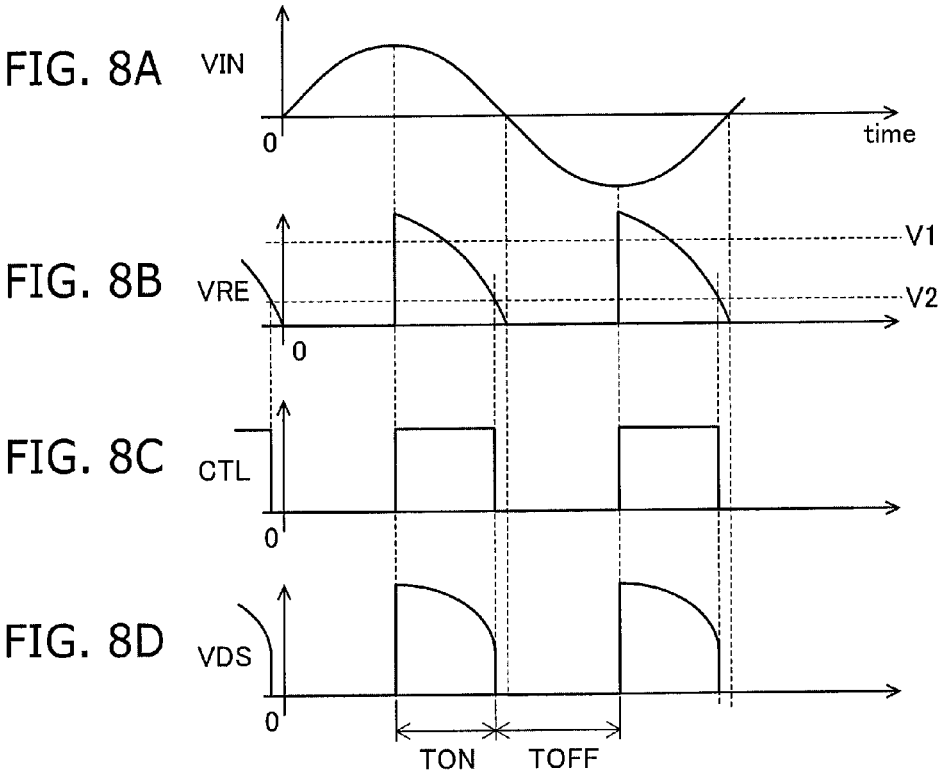
FIGS. 8A to 8D are timing charts of the main signals of the power supply for illumination according to the third embodiment.

FIGS. 8A to 8D are timing charts of the main signals of the power supply for illumination according to the third embodiment, wherein FIG. 8A shows the power supply voltage VIN, FIG. 8B shows the undulating voltage VRE, FIG. 8C shows the control signal CTL, and FIG. 8D shows a voltage VDS of the switching element.

The input power supply voltage VIN is, for example, an AC voltage of a commercial power supply, and is a sinusoidal voltage (FIG. 8A).

The undulating voltage VRE rectified by the rectifying circuit 9 is a voltage obtained by repeating the power supply voltage VIN input during the conduction period TON of the phase control on the positive side (FIG. 8B).

When the undulating voltage VRE increases from zero, the comparison circuit 21 outputs a high level, and compares the undulating voltage VRE with the first threshold voltage V1 which is relatively high. When the undulating voltage VRE increases over the first threshold voltage V1, the comparison circuit 21 outputs a low level. As a result, the inverter 25 outputs a high level as the control signal CTL (FIG. 8C).

Since the comparison circuit 21 outputs a low level, a threshold voltage of the comparison circuit 21 becomes the second threshold voltage V2 which is relatively low.

If the undulating voltage VRE decreases below the second threshold voltage V2, the comparison circuit 21 detects a zero-cross point and outputs a high level. As a result, the inverter 25 outputs a low level as the control signal CTL (FIG. 8C). A period of the high level of the control signal CTL is the conduction period TON of the phase control (FIG. 8C).

Since the control signal CTL is in a high level, the inverter 44 outputs a low level, and thus the switching element 45 enters a turned-off state. As a result, a current does not flow through the resistor 46, and the voltage VDS of the switching element 45 is almost the same as the undulating voltage VRE (FIG. 8D).

Since the comparison circuit 21 outputs a high level, a threshold voltage of the comparison circuit 21 becomes the first threshold voltage V1 which is relatively high.

If the undulating voltage VRE increases over the first threshold voltage V1, the comparison circuit 21 outputs a low level, and the inverter 25 outputs a high level as the control signal CTL (FIG. 8C). A period of the low level of the control signal CTL becomes the blocking period TOFF of the phase control (FIG. 8C).

Since the control signal CTL is in a low level, the inverter 44 outputs a high level, and thus the switching element 45 enters a turned-on state. As a result, the voltage VDS of the switching element 45 becomes nearly zero, thus a bleeder current flows through the resistor 46, and in turn an input current smaller than the output current IOUT flows between the input terminals 5 and 6. The impedance between the input terminals 5 and 6 of the power supply 3*b* for illumination is almost the same as a resistance value of the resistor 46 and thus becomes smaller than the impedance of the phase circuit 13 of the dimmer 8. As a result, the undulating voltage VRE becomes nearly zero during the blocking period TOFF of the phase control.

The control signal CTL is smoothened via the integration circuit constituted by the resistor 26 and the capacitor 27 and is input to the control circuit 11. In addition, as described above, the control circuit 11 outputs the output current IOUT according to the period of the high level of the control signal CTL, that is, the duration of the conduction period TON of the phase control.

During the period until the undulating voltage VRE decreases below the second threshold voltage V2 and then actually reaches the zero-cross point, the dimmer 8 is turned on, and thereby power consumption by the bleeder current occurs. The lower the second threshold voltage V2, the shorter the period until the undulating voltage VRE actually reaches the zero-cross point, and thus it is possible to reduce power consumption.

In the present embodiment, during the blocking period TOFF of the phase control, the bleeder circuit 43 makes an input current flow between the input terminals 5 and 6, and thereby the input impedance between the input terminals 5 and 6 of the power supply 3*b* for illumination is made smaller than the impedance of the phase circuit 13 of the dimmer 8. As a result, the undulating voltage VRE decreases nearly to zero during the blocking period TOFF of the phase control, and the second threshold voltage V2 for detecting the zero-cross point can be made relatively low, thereby reducing power consumption.

In addition, in the present embodiment, it is possible to more accurately detect the zero-cross point and to thereby more accurately detect the blocking period TOFF and the conduction period TON of the phase control. As a result, it is possible to further suppress a variation in the output current IOUT due to a variation in the power supply voltage or distortion of the power supply voltage. In addition, in the luminaire using the power supply for illumination according to the present embodiment, it is possible to more smoothly dim by further suppressing flickering due to a variation in the power supply voltage or distortion of the power supply voltage.

Effects other than the above-described effects of the present embodiment are the same as the effects of the first embodiment.

Fourth Embodiment

Figure 9:
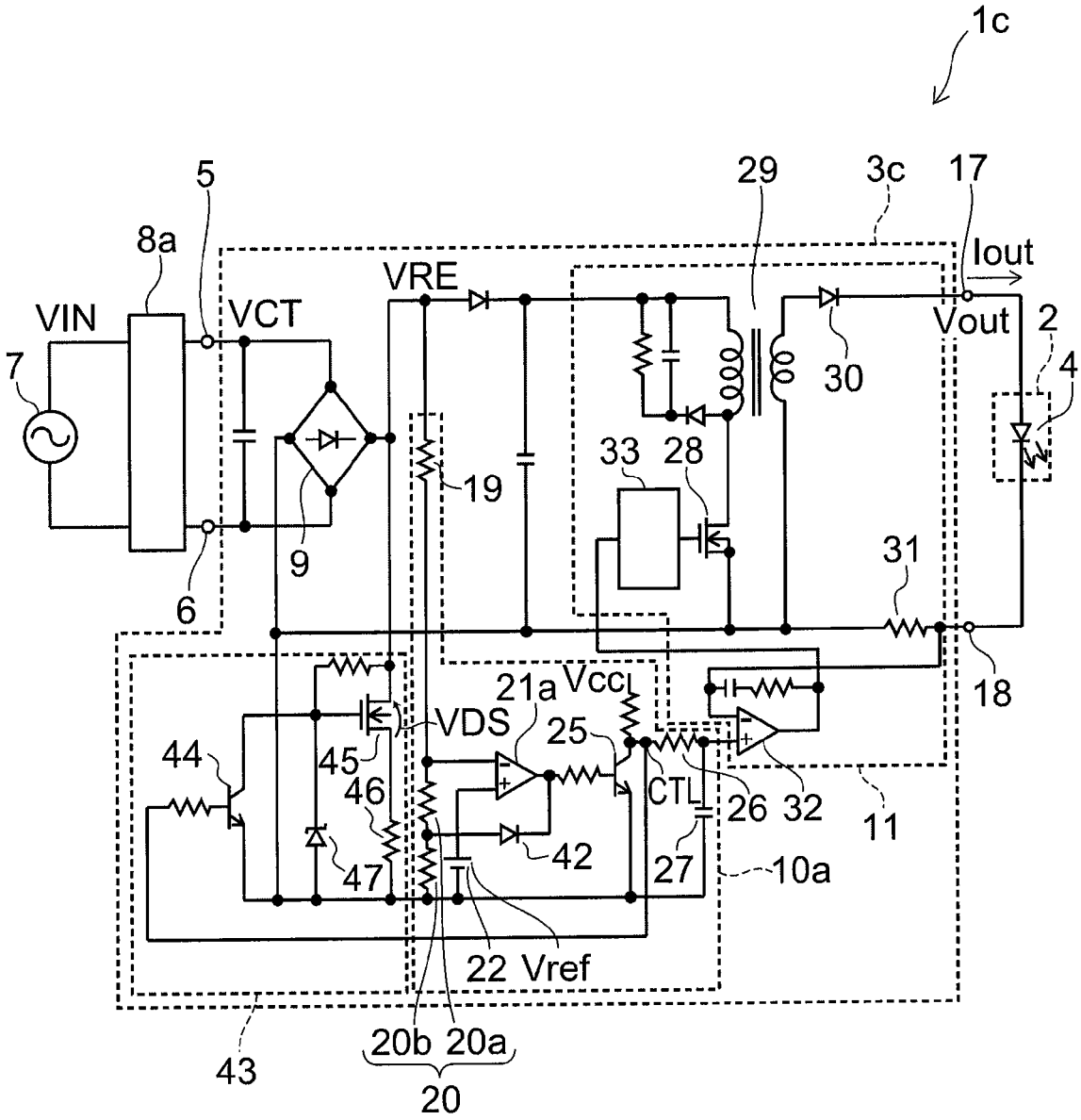
FIG. 9 is a circuit diagram exemplifying a luminaire including a power supply for illumination according to a fourth embodiment.

FIG. 9 is a circuit diagram exemplifying a luminaire including a power supply for illumination according to the fourth embodiment.

The luminaire 1*c* according to the fourth embodiment differs in a configuration of the power supply 3*a* for illumination as compared with the luminaire 1*a* according to the second embodiment. In other words, a power supply 3*c* for illumination of the luminaire 1*c* includes a bleeder circuit 43 which is further provided in the power supply 3*b* for illumination.

Configurations other than the above-described configuration of the luminaire 1*c* are the same as the configurations of the luminaire 1*a*.

The bleeder circuit 43 is the same as the bleeder circuit 43 of the power supply 3*b* for illumination according to the third embodiment, and thus description thereof will be omitted.

Figures 10A, 10B, 10C, 10D:
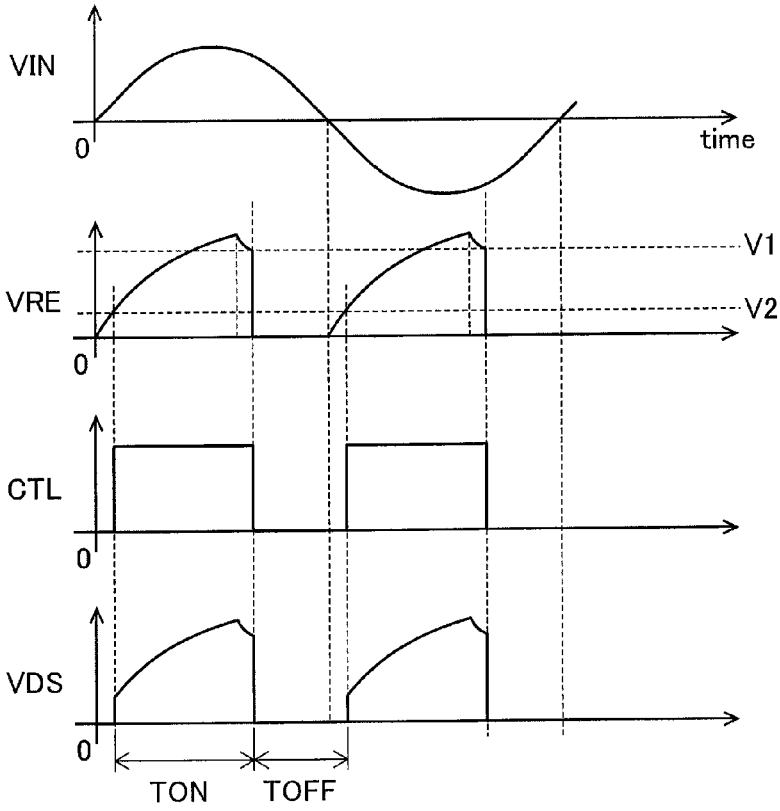
FIGS. 10A to 10D are timing charts of the main signals of the power supply for illumination according to the fourth embodiment.

FIGS. 10A to 10D are timing charts of the main signals of the power supply for illumination according to the fourth embodiment, wherein FIG. 10A shows the power supply voltage VIN, FIG. 10B shows the undulating voltage VRE, FIG. 10C shows the control signal CTL, and FIG. 10D shows a voltage VDS of the switching element.

The input power supply voltage VIN is, for example, an AC voltage of a commercial power supply, and is a sinusoidal voltage (FIG. 10A). The dimmer 8*a* is a three-wire type dimmer in which the circuit controlling the semiconductor switch 35 is inserted in parallel into the power supply lines, and the post-cut phase control (reverse phase control) where an operation and a control phase in the dimmer 8 are reversed is exemplified (FIG. 10B).

The undulating voltage VRE rectified by the rectifying circuit 9 is a voltage obtained by repeating the power supply voltage VIN input during the conduction period TON of the phase control on the positive side (FIG. 10B).

When the undulating voltage VRE increases from zero, the comparison circuit 21*a* outputs a high level, and compares the undulating voltage VRE with the second threshold voltage V2 which is relatively low. When the undulating voltage VRE increases over the second threshold voltage V2, the comparison circuit 21*a* outputs a low level. As a result, the inverter 25 outputs a high level as the control signal CTL (FIG. 10C).

Since the control signal CTL is in a high level, the inverter 44 outputs a low level, and thus the switching element 45 enters a turned-off state. As a result, a current does not flow through the resistor 46, and the voltage VDS of the switching element 45 is almost the same as the undulating voltage VRE (FIG. 10D).

Since the comparison circuit 21*a* outputs a low level, a threshold voltage of the comparison circuit 21*a* becomes the first threshold voltage V1 which is relatively high.

If the undulating voltage VRE increases to a peak value and then decreases below the first threshold voltage V1, the comparison circuit 21*a* outputs a high level. As a result, the inverter 25 outputs a low level as the control signal CTL (FIG. 10C). A period of the high level of the control signal CTL is the conduction period TON of the phase control (FIG. 10C).

Since the comparison circuit 21*a* outputs a high level, a threshold voltage of the comparison circuit 21*a* becomes the second threshold voltage V2 which is relatively low.

If the undulating voltage VRE increases over the second threshold voltage V2, the comparison circuit 21*a* outputs a low level, and the inverter 25 outputs a high level as the control signal CTL (FIG. 10C). A period of the low level of the control signal CTL becomes the blocking period TOFF of the phase control (FIG. 10C).

Since the control signal CTL is in a low level, the inverter 44 outputs a high level, and thus the switching element 45 enters a turned-on state. As a result, the voltage VDS of the switching element 45 becomes nearly zero, thus a bleeder current flows through the resistor 46, and in turn an input current smaller than the output current IOUT flows between the input terminals 5 and 6. The impedance between the input terminals 5 and 6 of the power supply 3*c* for illumination is almost the same as a resistance value of the resistor 46 and thus becomes smaller than the impedance of the bias circuit constituted by the resistor 38 and the capacitor 39 of the dimmer 8*a*. As a result, the undulating voltage VRE becomes nearly zero during the blocking period TOFF of the phase control.

The control signal CTL is smoothened via the integration circuit constituted by the resistor 26 and the capacitor 27 and is input to the control circuit 11. In addition, as described above, the control circuit 11 outputs the output current IOUT according to the period of the high level of the control signal CTL, that is, the duration of the conduction period TON of the phase control.

During the period until the undulating voltage VRE actually reaches the zero-cross point and then increases over the second threshold voltage V2, the dimmer 8 is turned on, and thereby power consumption by the bleeder current occurs. The lower the second threshold voltage V2, the shorter the period until the undulating voltage VRE actually reaches the zero-cross point and then the detection circuit detects the zero-cross point, and thus it is possible to reduce power consumption.

In the present embodiment as well, during the blocking period TOFF of the phase control, the bleeder current flows between a pair of output terminals of the rectifying circuit 9, and thereby the input impedance between the input terminals 5 and 6 of the power supply 3*c* for illumination is made smaller than the impedance of the phase circuit 13 of the dimmer 8*a*. As a result, the undulating voltage VRE decreases nearly to zero during the blocking period TOFF of the phase control, and the second threshold voltage V2 for detecting the zero-cross point can be made relatively low, thereby reducing power consumption.

Effects other than the above-described effects of the present embodiment are the same as the effects of the second embodiment.

As above, although the embodiments have been described with reference to the detailed examples, the present invention is not limited thereto, and may have various modifications.

For example, the illumination light source 4 may be an LED or an OLED, and the illumination light source 4 may have a configuration where a plurality of LEDs are connected in series or in parallel to each other.

In addition, although the fly-back type DC-DC converter constituted by the switching element 28, the transformer 29, and the like has been exemplified as the control circuit 11, other configurations may be employed as long as the output voltage VOUT and the output current IOUT for lighting the illumination load 2 can be generated.

The dimmer 8*a* used in the description of the second and fourth embodiments may be replaced with the dimmer 8 and used for pre-cut phase control in the same manner as the dimmer 8 used in the description of the first and third embodiments.

Although some embodiments of the present invention have been described, the embodiments are presented as an example and are not intended to limit the scope of the invention. These novel embodiments can be implemented as other various forms and may carry out various omissions, alterations, and modifications in the scope without departing from the spirit of the invention. These embodiments and modifications thereof are included in the scope and the spirit of the invention and are also included in the invention recited in the claims and the equivalent scope thereof.

What is claimed is:

1. A power supply for illumination comprising:

a detection circuit that compares an AC voltage, whose phase is controlled, with a first threshold voltage so as to detect a variation in a conduction state of the phase-controlled AC voltage, and compares the phase-controlled AC voltage with a second threshold voltage lower than the first threshold voltage so as to detect a zero-crossing point of the phase-controlled AC voltage, thereby detecting a conduction period of the phase-controlled AC voltage;

a control circuit that outputs an output current according to the duration of the conduction period; and a bleeder circuit through which an input current smaller than the output current flows during a blocking period of the phase-controlled AC voltage.

2. The power supply according to claim 1, wherein the detection circuit compares an undulating voltage obtained by rectifying the phase-controlled AC voltage with the first threshold voltage and the second threshold voltage.

3. The power supply according to claim 1, wherein the detection circuit compares the phase-controlled AC voltage with the first threshold voltage so as to detect a start time of the conduction period of the phase-controlled AC voltage.

4. The power supply according to claim 3, wherein the detection circuit compares the phase-controlled AC voltage with the second threshold voltage so as to detect an end time of the conduction period of the phase-controlled AC voltage.

5. The power supply according to claim 1, wherein the detection circuit compares the phase-controlled AC voltage with the second threshold voltage so as to detect a start time of the conduction period of the phase-controlled AC voltage.

6. The power supply according to claim 5, wherein the detection circuit compares the phase-controlled AC voltage with the first threshold voltage so as to detect an end time of the conduction period of the phase-controlled AC voltage.

7. The power supply according to claim 1, wherein the detection circuit compares the phase-controlled AC voltage with a reference voltage which varies depending on an output voltage of the detection circuit.

8. The power supply according to claim 1, wherein the detection circuit varies resistance values of dividing resistors which divide the phase-controlled AC voltage, depending on an output voltage of the detection circuit.

9. The power supply according to claim 1, wherein the first threshold voltage is lower than an instantaneous value of the phase-controlled AC voltage, wherein the instantaneous value is a point in the phase of the phase phase-controlled AC voltage where the conduction state of the phase-controlled AC voltage begins.

10. A luminaire comprising:

a power supply for illumination; and an illumination load connected to the power supply for illumination as a load, wherein the power supply for illumination includes a detection circuit that compares an AC voltage, whose phase is controlled, with a first threshold voltage so as to detect a variation in a conduction state of phase control in the phase-controlled AC voltage, and compares the phase-controlled AC voltage with a second threshold voltage lower than the first threshold voltage so as to detect a zero-crossing point of the phase-controlled AC voltage, thereby detecting a conduction period of the phase-controlled AC voltage, and varies resistance values of dividing resistors, which divide the phase-controlled AC voltage, depending on an output voltage of the detection circuit; and a control circuit that outputs an output current according to the duration of the conduction period.

11. The luminaire according to claim 10, wherein the detection circuit compares an undulating voltage obtained by rectifying the phase-controlled AC voltage with the first threshold voltage and the second threshold voltage.

12. The luminaire according to claim 10, wherein the detection circuit compares the phase-controlled AC voltage with the first threshold voltage so as to detect a start time of the conduction period of the phase-controlled AC voltage.

13. The luminaire according to claim 12, wherein the detection circuit compares the phase-controlled AC voltage with the second threshold voltage so as to detect an end time of the conduction period of the phase-controlled AC voltage.

14. The luminaire according to claim 10, wherein the detection circuit compares the phase-controlled AC voltage with the second threshold voltage so as to detect a start time of the conduction period of the phase-controlled AC voltage.

15. The luminaire according to claim 14, wherein the detection circuit compares the phase-controlled AC voltage with the first threshold voltage so as to detect an end time of the conduction period of the phase-controlled AC voltage.

16. The luminaire according to claim 10, wherein the detection circuit compares the phase-controlled AC voltage with a reference voltage which varies depending on an output voltage of the detection circuit.

17. The luminaire according to claim 10, further comprising a dimmer that outputs an AC voltage, whose phase is controlled, to the power supply.

18. A power supply for illumination comprising:

a detection circuit that compares an AC voltage, whose phase is controlled, with a first threshold voltage so as to detect a variation in a conduction state of phase-controlled AC voltage, and compares the phase-controlled AC voltage with a second threshold voltage lower than the first threshold voltage so as to detect a zero-crossing point of the phase-controlled AC voltage, thereby detecting a conduction period of the phase-controlled AC voltage; and a control circuit that outputs an output current according to the duration of the conduction period, wherein the detection circuit varies resistance values of dividing resistors, which divide the phase-controlled AC voltage, depending on an output voltage of the detection circuit, wherein the first threshold voltage is set to be lower than an instantaneous value of the phase-controlled AC voltage, and wherein the instantaneous value is at a point in the phase of the phase-controlled AC voltage where the conduction state begins.

* * * * *